US008851181B2

(12) United States Patent
Cohen

(10) Patent No.: US 8,851,181 B2
(45) Date of Patent: Oct. 7, 2014

(54) METHOD FOR CIRCULATING A FLUID ENTRY OUT OF A SUBSURFACE WELLBORE WITHOUT SHUTTING IN THE WELLBORE

(71) Applicant: AGR Subsea, A.S., Straume (NO)

(72) Inventor: John Cohen, Houston, TX (US)

(73) Assignee: AGR Subsea, A.S., Straume (NO)

( * ) Notice: Subject to any disclaimer, the term of this patent is extended or adjusted under 35 U.S.C. 154(b) by 0 days.

(21) Appl. No.: 13/794,888

(22) Filed: Mar. 12, 2013

(65) Prior Publication Data

US 2013/0186636 A1 Jul. 25, 2013

Related U.S. Application Data

(63) Continuation of application No. 12/786,456, filed on May 25, 2010, now Pat. No. 8,413,722.

(51) Int. Cl.
*E21B 21/00* (2006.01)
*E21B 21/08* (2006.01)

(52) U.S. Cl.
CPC ..... *E21B 21/001* (2013.01); *E21B 21/08* (2013.01)
USPC ..... 166/335; 166/368; 175/217

(58) Field of Classification Search
CPC ..... E21B 21/08
USPC ..... 166/335, 368, 367, 316, 105, 386; 175/24, 38, 48, 217, 218
See application file for complete search history.

(56) References Cited

U.S. PATENT DOCUMENTS

| | | | | | |
|---|---|---|---|---|---|
| 3,415,331 | A * | 12/1968 | Van Gils | 175/65 |
| 3,443,643 | A * | 5/1969 | Jones | 175/25 |
| 3,470,972 | A * | 10/1969 | Dower | 175/25 |
| 3,809,170 | A * | 5/1974 | Ilfrey et al. | 175/7 |
| 5,006,845 | A * | 4/1991 | Calcar et al. | 367/81 |
| 6,474,422 | B2 * | 11/2002 | Schubert et al. | 175/69 |
| 6,484,816 | B1 * | 11/2002 | Koederitz | 175/25 |
| 6,966,392 | B2 * | 11/2005 | deBoer | 175/70 |
| 8,235,143 | B2 * | 8/2012 | Tseytlin | 175/48 |
| 8,413,722 | B2 * | 4/2013 | Cohen | 166/335 |
| 2002/0108782 | A1 * | 8/2002 | Boer | 175/7 |
| 2003/0168258 | A1 * | 9/2003 | Koederitz | 175/38 |
| 2006/0207795 | A1 * | 9/2006 | Kinder et al. | 175/38 |

* cited by examiner

*Primary Examiner* — James Sayre
(74) *Attorney, Agent, or Firm* — Richard A. Fagin

(57) ABSTRACT

A method for removing a fluid influx from a subsea wellbore drilled using a pump to return fluid from the wellbore to the surface. The method includes detecting the influx when a rate of the return pump increases. Flow from the wellbore is diverted from the return pump to a choke line when the influx reaches the wellhead. A choke in the choke line is operated so that a substantially constant bottom hold pressure is maintained while drilling fluid continues to be pumped through the drill sgring. Fluid flow from the wellbore is redirected to the return pump inlet when the influx has substantially left the well.

12 Claims, 15 Drawing Sheets

METHOD FOR CIRCULATING A FLUID ENTRY OUT OF A SUBSURFACE WELLBORE WITHOUT SHUTTING IN THE WELLBORE

CROSS-REFERENCE TO RELATED APPLICATIONS

Continuation of U.S. patent application Ser. No. 12/786,456 filed on May 25, 2010, now U.S. Pat. No. 8,413,722, and incorporated herein by reference in its entirety.

STATEMENT REGARDING FEDERALLY SPONSORED RESEARCH OR DEVELOPMENT

Not applicable.

BACKGROUND

This disclosure relates generally to the field of drilling wellbores through subsurface rock formations. More particularly, the disclosure relates to method for removing fluid that has entered the wellbore from subsurface formations outside the wellbore.

Drilling wellbores through subsurface rock formations includes inserting a drill string into the wellbore. The drill string, which is typically assembled by segments ("joints" or "stands") of pipe threadedly coupled end to end) has a bit at its lower end. The drill string is suspended in a hoist unit that forms part of a drilling "rig." During drilling, a specialized fluid ("mud") is pumped from a tank into a passage in the interior of the drill string and is discharged through courses or nozzles on the bit. The mud cools and lubricates the bit and lifts drill cuttings to the surface for treatment and disposal. The mud also typically includes high density particles such as barite (barium sulfate), hematite (iron oxide), or other weighting agents suspended therein to cause the mud to have a selected density. The density is selected to provide sufficient hydrostatic pressure in the wellbore to prevent fluid in the pore spaces of the rock formations from entering the wellbore. The density is also selected to maintain mechanical integrity of the wellbore.

Wellbores drilled through subsurface formations below the bottom of a body of water, particularly if the water is very deep (e.g., on the order of 1,000-3,000 meters or more) may require special equipment for effective drilling. An example drilling system for such water depths is shown in FIG. 1. The drill string 28 extends from a drilling rig (not shown for clarity) and is disposed in a wellbore 14 being drilled through rock formations 12 below the bottom of a body of water 10 such as a lake or the ocean. A wellhead 16 including a plurality of sealing devices collectively called a "BOP stack" is disposed at the top end of a surface casing 14A cemented in place to a relatively shallow depth below the mud line. A marine riser 26 extends from the upper part of the wellhead 20 to the drilling rig (not shown). The riser 26 usually has auxiliary lines associated with it known as "choke" lines 24, and a "kill line" 22. Fluid may be pumped into such lines from the rig (not shown) toward the wellbore 14 or may be allowed to move from the wellbore 14 toward the surface. Valves 18, 20 control fluid movement at the lower end of the kill line 22. Corresponding valves 30, 32 control fluid movement at the lower end of the choke line 24.

In the present example, the riser 26 is hydraulically opened to the wellbore 14 below. In order to maintain a hydrostatic pressure in the wellbore annulus 13 that is lower than would be provided if the entire length of the riser 26 were filled with mud, the riser 26 may be partially or totally filled with sea water. See, for example, U.S. Pat. No. 6,454,022 issued to Sangesland et al. As the mud leaves the wellbore annulus 13 (the space between the drill string and the wellbore wall), it is diverted, through suitable valves 34, 36 to a pump 38 that lifts the mud to the surface through a separate mud return line 40. Typically, the pump 38 is operated so that the interface between the drilling mud and the water column above in the riser 26 is maintained at a selected level. Maintaining the selected level causes a selected hydrostatic pressure to be maintained in the wellbore 14.

The issue dealt with by methods according to the present invention is to safely remove from the wellbore 14 any fluid which enters from the rock formations 12. Such fluid, by reason of its entry, is at a higher pressure than the total hydrostatic pressure exerted by the mud column in the annulus 13 and the column of sea water in the riser 26. Methods known in the art for dealing with such fluid entry require "shutting in the well", meaning that the BOP stack is closed to seal against the drill string 28, and fluid pumping is stopped. Frequently during such operation, the density of the drilling fluid will be increased by adding more dense, powdered material to the mud. See for example U.S. Pat. No. 6,474,422 issued to Schubert et al. for an example of a kick control method.

It is also possible that the pressures necessary to be applied to the mud return pump and its connecting lines may be exceeded if conventional kick control methods are used.

It is desirable to have a method for removing kick fluid from a wellbore that does not require the kick fluid to go through the pump, but maintains well bore pressures at acceptable levels. These pressures must be high enough to keep additional formation fluids from entering the wellbore from one formation, while not exceeding the fracture pressure (pressure that cases wellbore fluids to enter the formation) of other exposed formations, most specifically the formation at the last casing shoe, which is the end of the last installed casing.

SUMMARY

One aspect of the disclosure is a method for removing a fluid influx from a wellbore. The wellbore is drilled using a drill string having an internal passage therethrough. The wellbore has a wellhead disposed proximate a bottom of a body of water disposed thereabove. A fluid outlet of the wellbore is coupled to an inlet of a mud return pump. An outlet of the return pump is coupled to a return line to the water surface. A riser is disposed above the wellhead and extends to the water surface. The riser is substantially or partially filled with a fluid less dense than a fluid pumped through the drill string. The method includes detecting the influx when a rate of the return pump increases. Flow out from the well is diverted from the return pump inlet to a choke line when the influx reaches the wellhead. A choke in the choke line is operated so that a substantially constant bottom hole pressure is maintained while drilling fluid continues to be pumped through the drill string. Fluid flow from the well is rediverted to the return pump inlet when the influx has substantially left the wellbore.

In one example, an interface level in the riser between the less dense fluid and the fluid pumped through the drill string is then increased to increase fluid pressure at the bottom of the well. A method according to one aspect of the invention for removing a fluid influx from a subsea drilling wellbore drilled using a pump to return drilling fluid from the wellbore to the sea surface. The fluid influx is observed when an operating rate of the return pump increases. Drilling fluid continues to be pumped through the drill string and the return pump until the fluid influx reaches the wellhead. The return pumping is performed at a rate such that a flow into the wellbore substantially equals a flow out of the wellbore. An intake to the return pump is hydraulically isolated from the wellbore. Flow out of the wellbore is diverted to a choke line. The choke is operated so that the flow into the wellbore substantially equals a flow out of the wellbore. Flow out of the wellbore back to the intake of the return pump when an end of the influx reaches the wellhead. The less dense fluid is pumped down an auxiliary line proximate a bottom end thereof to proximate a bottom end of the choke line. Influx fluid is displaced from the choke line using the less dense fluid.

In one example, drilling fluid is pumped down the auxiliary line into a lower end of the riser to raise an interface level between drilling fluid and less dense fluid in a riser above the wellhead such that a fluid pressure at the bottom of the well is at least as much as fluid pressure in rock formations penetrated by the wellbore.

Other aspects and advantages of the invention will be apparent from the following description and the appended claims.

DETAILED DESCRIPTION

A well control procedure described herein will enable circulating out a fluid influx ("kick") from a rock formation when drilling in dual gradient mode through a line auxiliary to a drilling riser, such as a choke line. The procedure is dynamic and never exposes the wellbore to a complete column of drilling mud from the bottom of the well to the surface (in the riser). Such a mud column could exert enough hydrostatic pressure to fracture the formations exposed by the wellbore.

Figure 1:
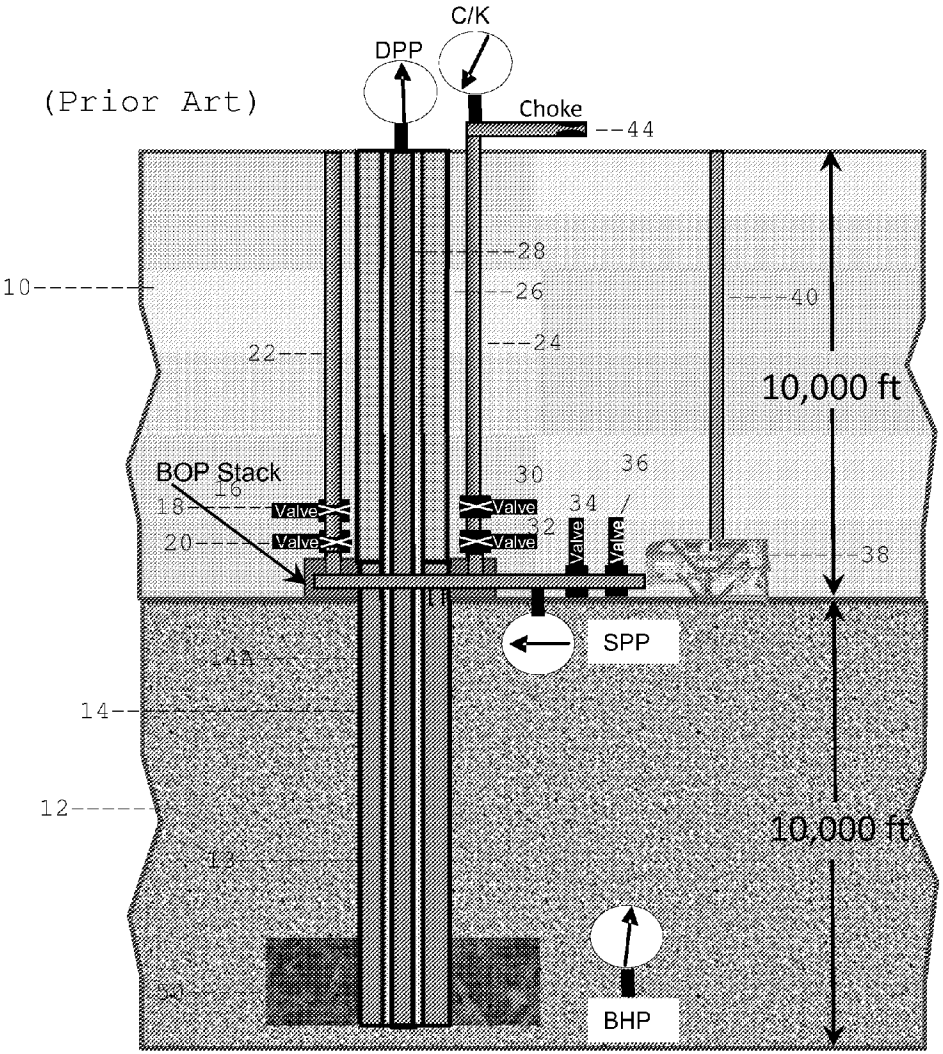
FIG. 1 is an example prior art mud lift drilling system.

FIG. 1, as explained in the Background section herein, represents drilling under normal conditions, wherein no fluid enters the wellbore from any formation exposed by the wellbore. When drilling is under normal conditions, the drilling system may be configured as shown in FIG. 1, specifically, the riser 26 and choke and kill ("C&K") lines are filled with seawater. The C&K lines are isolated from the wellbore 14 by keeping its lower control valves 18, 20, 30, 32 closed. The pump inlet valves 34, 36 are open and the pump 38 is operated to lift drilling mud to the surface. A pump suction pressure sensor SPP measures annulus discharge pressure, typically proximate the intake of the pump 38. The pressure sensor SPP as well as other pressure sensors described below may be coupled to a controller (not shown) for automatic or semi-automatic control over various components of the system. Alternatively, measurements made by the sensors may be communicated to the system operator for manual operation. Operation of the pump 38 is typically maintained automatically at a set point pressure as measured by the sensor SPP, which operation keeps the mud/seawater interface in the riser 26 at a constant level. The riser 26 is open to wellbore 14 as explained in the Background section herein, and includes sea water therein above the interface. The sea water may extend all the way to the surface or to a selected depth below the surface.

Figure 2:
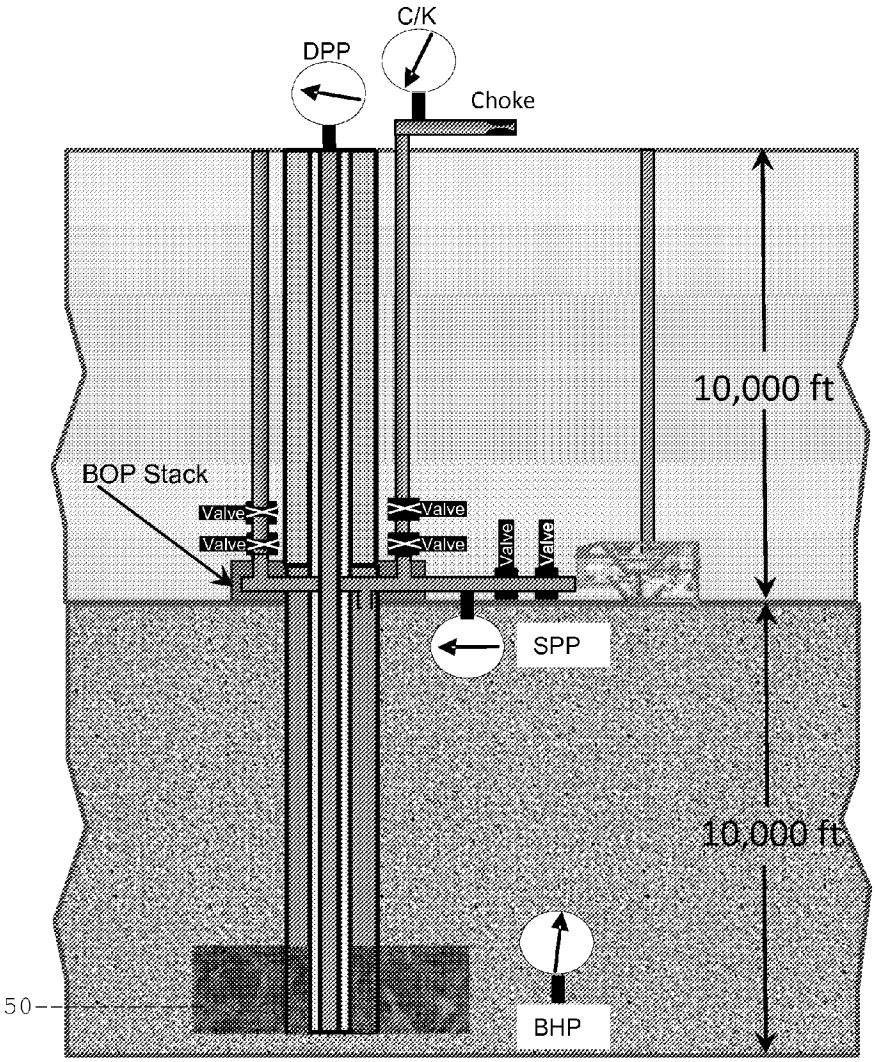
FIGS. 2-15 show various elements of a method according to the invention that can be performed using the system shown in FIG. 1. In the various figures, like components will be identified using like reference numerals.

FIG. 2 shows an example ten barrel volume fluid influx ("kick") 50 entering the wellbore. Such a kick fills about 100 meters of the wellbore with kick fluid, although the length of the wellbore filled by any particular kick will depend, as is known in the art, on the actual volume of the kick, the diameter of the drill string and the diameter of the wellbore. It can be observed that the pump 38 speed and horsepower output will increase in response in order to move the extra fluid volume resulting from the fluid influx (kick). The system operator may determine from observation of the pump speed and/or power measured by sensors that a kick has entered the well. Generally, the pump speed and/or power measurement increases due to the kick 50 because the pump 38 response to the extra fluid volume. As the kick enters the wellbore it may cause movement of the mud/seawater interface in the riser upward; this will have the effect of increasing the SPP reading (more mud, less water in the riser). However, the control program, having sensed this increase in pressure will speed the pump 38 up and restore the level to what is was (the level only changes an inch or two) prior to the kick, This will then restore SPP back to what it was. Once it is observed that a kick is occurring from the change in pump speed and/or power the SPP setpoint may be changed to increase pressure. This has the effect of slowing the pump 38 so that it supports less of the column of fluid in the mud return line adding pressure to the bottom the well and killing the kick. It should be understood that observing the increase in pump speed is only one technique for observing an influx. It is also possible to include a flow meter at a selected position in the mud return line and observe an increase in flow rate. Other techniques for observing the influx will occur to those skilled in the art.

Figure 3:
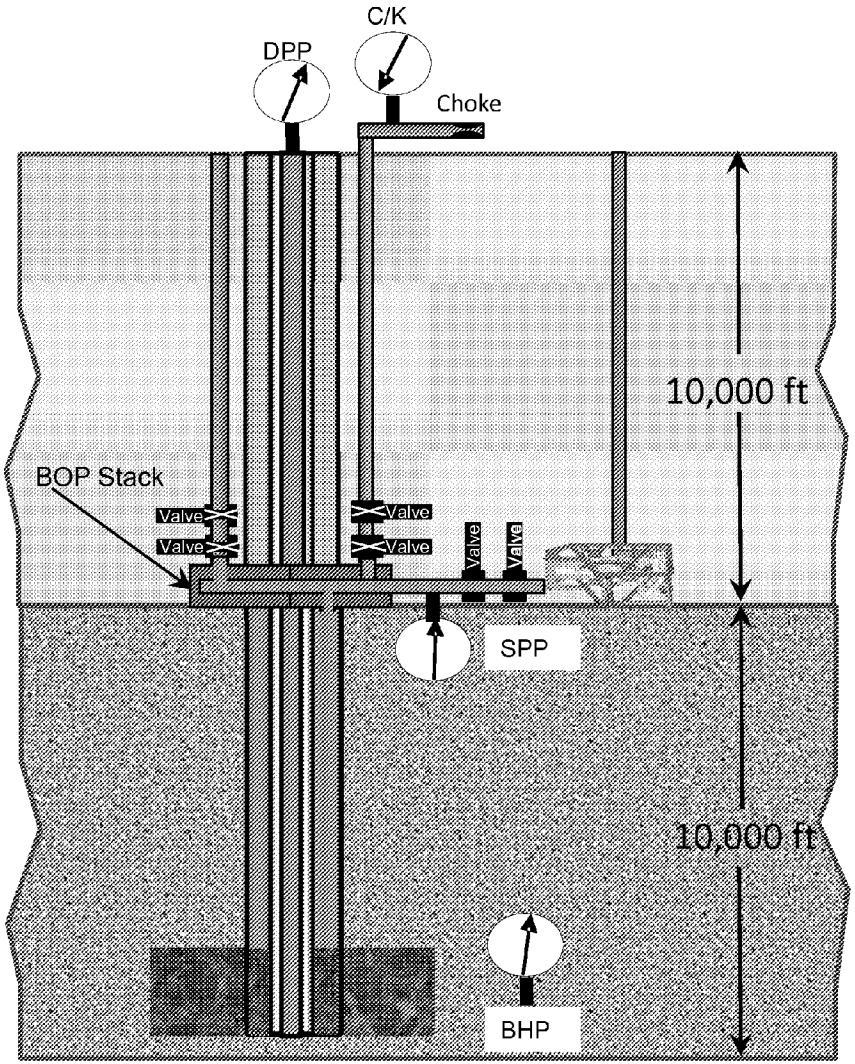

FIG. 3 shows an initial action in controlling and circulating out the kick 50. An annular preventer (not shown separately) in the BOP stack 16 is closed around the drill string, thereby isolating the wellbore 14 from the riser 26. The suction set point pressure may be increased to control the kick 50. This can be performed by slowing the operating rate of the pump 38. The pump rate is slowed, and the suction pressure (as measured by the sensor SPP) is increased until the flow rate of mud into well ("flow in"—pumped through the drill string 28 and the rate of flow out of well ("flow out"—through the return line 40) are substantially equal. When the flow in and the flow out are substantially equal, no additional fluid is entering well. At such condition, the kick 50 has been stopped or "killed." It is then necessary to circulate the kick fluid out of the wellbore 14 in a controlled manner. Kick fluid frequently contains gas, in solution and/or as actual bubbles. As the kick fluid moves toward the surface, and hydrostatic pressure is reduced, the gas exsolves from the kick fluid and/or expands in volume. When the flow rates in and out are balanced, the drill string pressure increases, which may be observed by measurements made using a drill string pressure sensor DPP.

Figure 4:
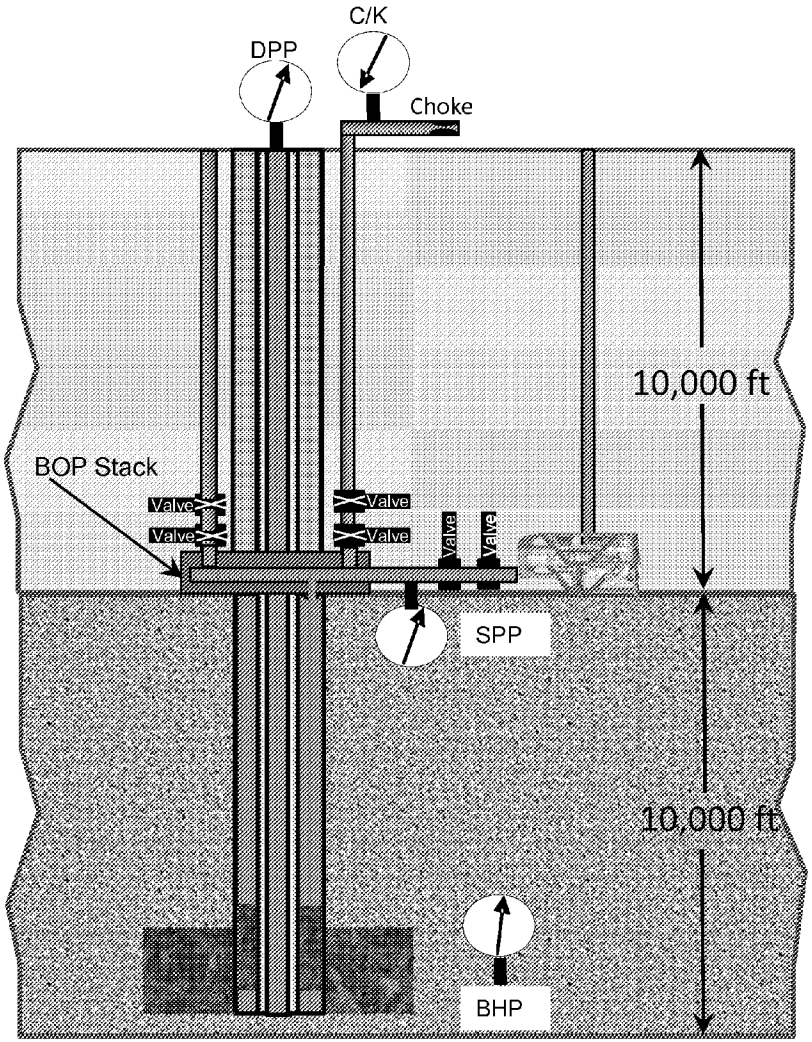

FIG. 4 shows the situation where the rig mud pump (the pump that moves mud through the interior of the drill string) rate is slowed, but the rate is sufficient to keep the drill string full of mud. The kick fluid begins moving up wellbore annulus 13. At this point, the mud return pump 38 is operated so that the intake pressure (measured by the sensor SPP) is increased to maintain a constant drill pipe pressure (as measured by sensor DPP). The mud return pump 38 should be operated to maintain fluid flow out equal to fluid flow in.

Figure 5:
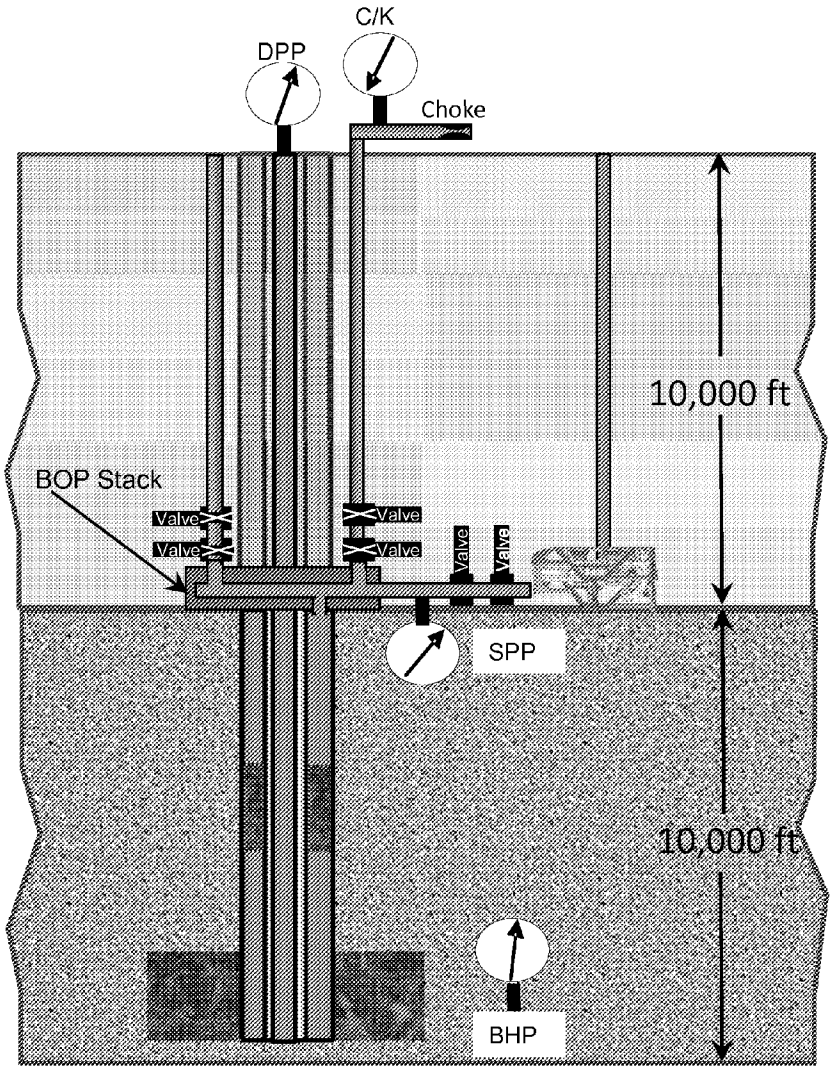

FIG. 5 shows the kick fluid moving up the wellbore and beginning to expand in volume. During such time, the operator continues to control the mud return pump 38 speed so to maintain constant drill string pressure (measured by sensor DPP) and to cause flow out to be substantially equal to flow in.

Figure 6:
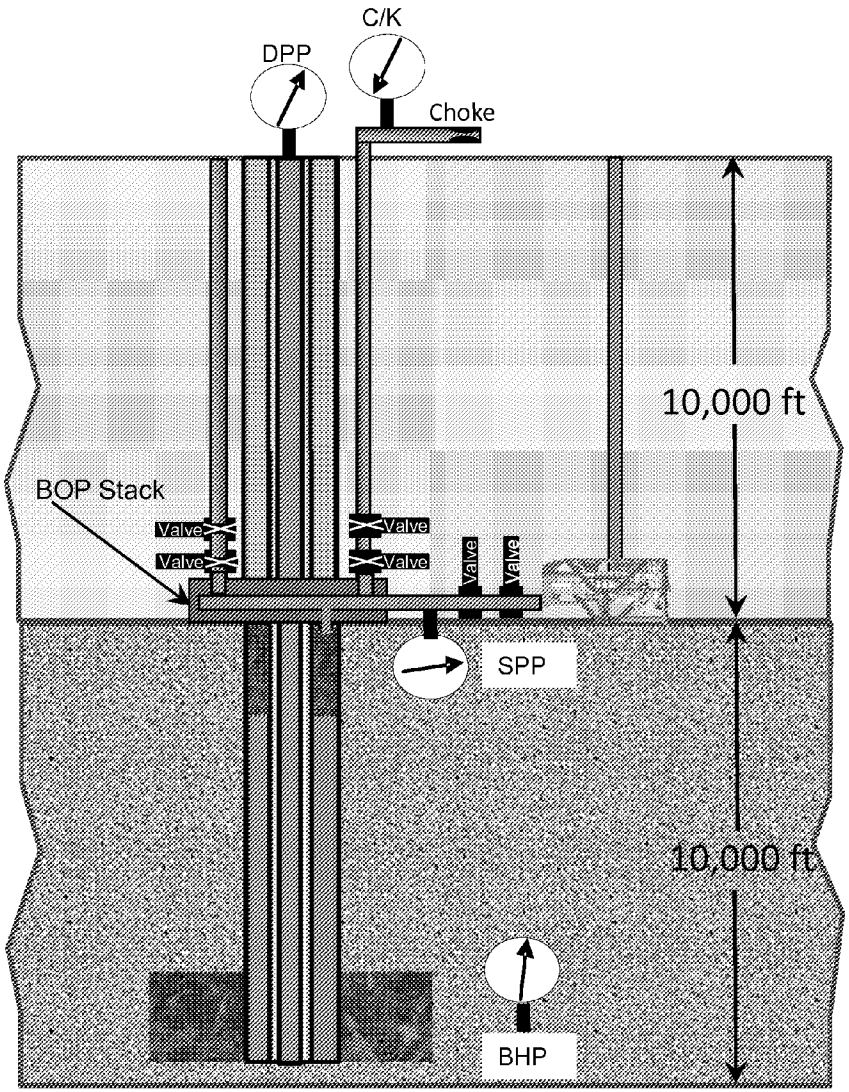

FIG. 6 shows continuing to adjust the mud return pump 38 speed to keep constant drill string pressure. The mud return pump 38 speed is also controlled to maintain flow out matching flow in. At the point shown in FIG. 6, the kick fluid 50 has reached the BOP stack 16.

Figure 7:
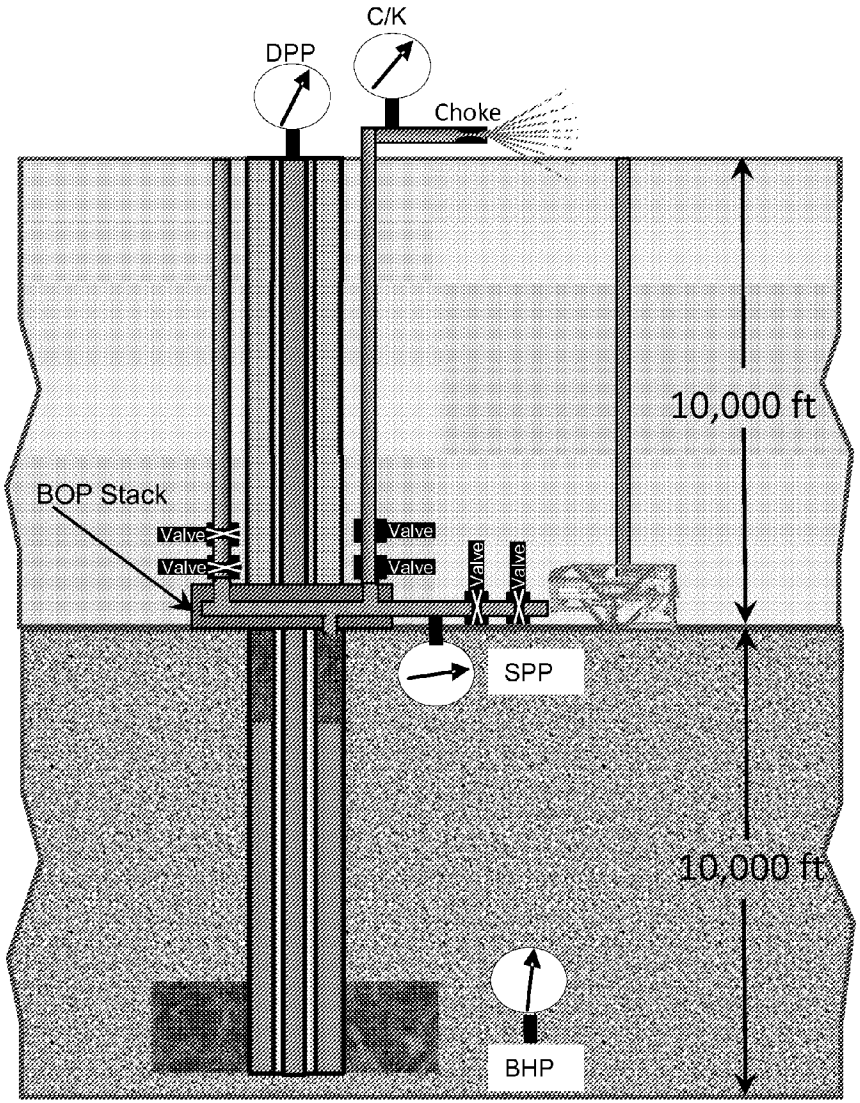

FIG. 7 shows opening the valves 30, 32 to the choke line 24. A variable orifice choke 44 coupled to the surface end of the choke line 24 is operated to maintain fluid pressure at the bottom of the wellbore (bottom hole pressure) substantially constant. Bottom hole pressure may be measured by a sensor (not shown) in the drill string, or may be estimated using the density of the drilling mud, and an hydraulic model that describes the flow system including the drill bit, wellbore walls, drill string and rheological properties of the mud.

When the valves 30, 32 to the choke line 24 are opened, the valves 34, 36 to the intake side of the mud return pump 38 are closed. Thus, further flow out of the wellbore 14 will move up the choke line 24. When the pump intake valves 34, 36 are closed, the mud return pump 38 is stopped. It may be necessary that the flow rate into the well will have to be reduced to avoid excess pressure from friction of the fluid in the smaller choke line 24.

Figure 8:
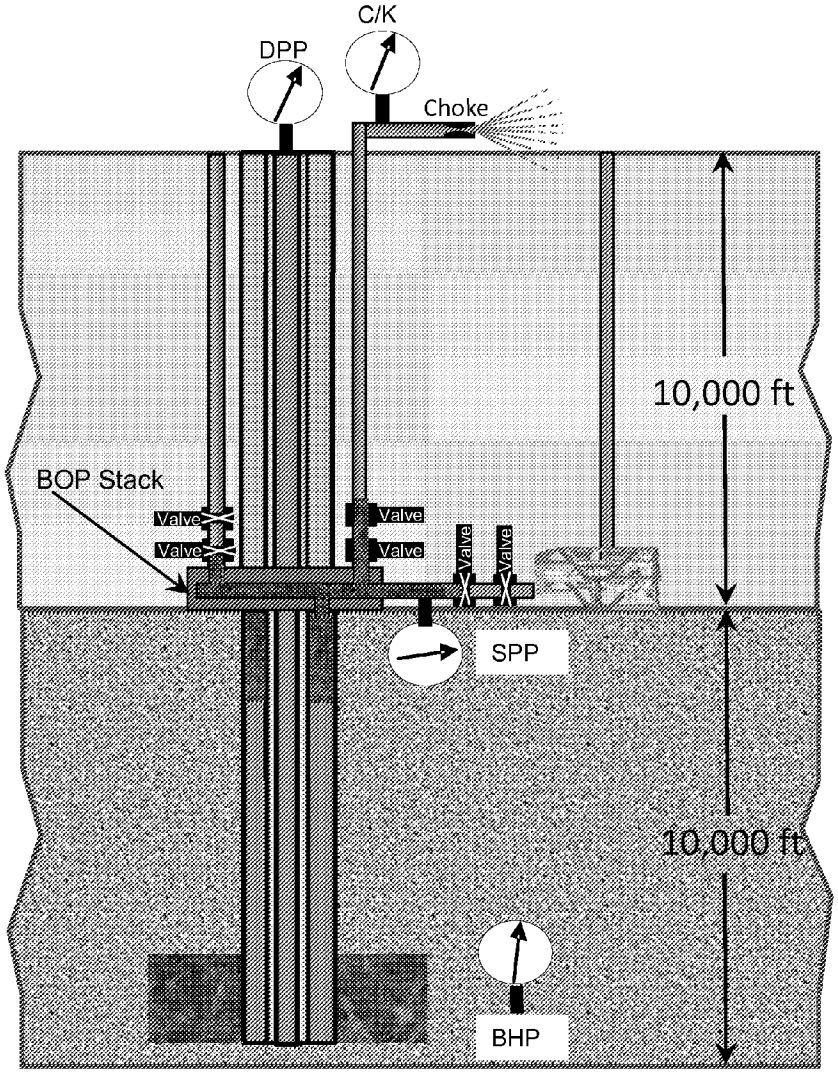

FIG. 8 shows that the kick fluid 50 is less dense than the mud and seawater, and thus displaces the sea water in the choke line 24. The surface choke 44 continues to be operated to keep the bottom hole pressure substantially constant. Note that the foregoing is correct for water based drilling fluid. If oil based drilling fluid is used, the oil based fluid will be very close to its original density because any gas will be dissolved in the oil based fluid. Reduction of fluid density will not occur until exsolution of the gas. When this actually takes place varies depending on wellbore conditions.

Figure 9:
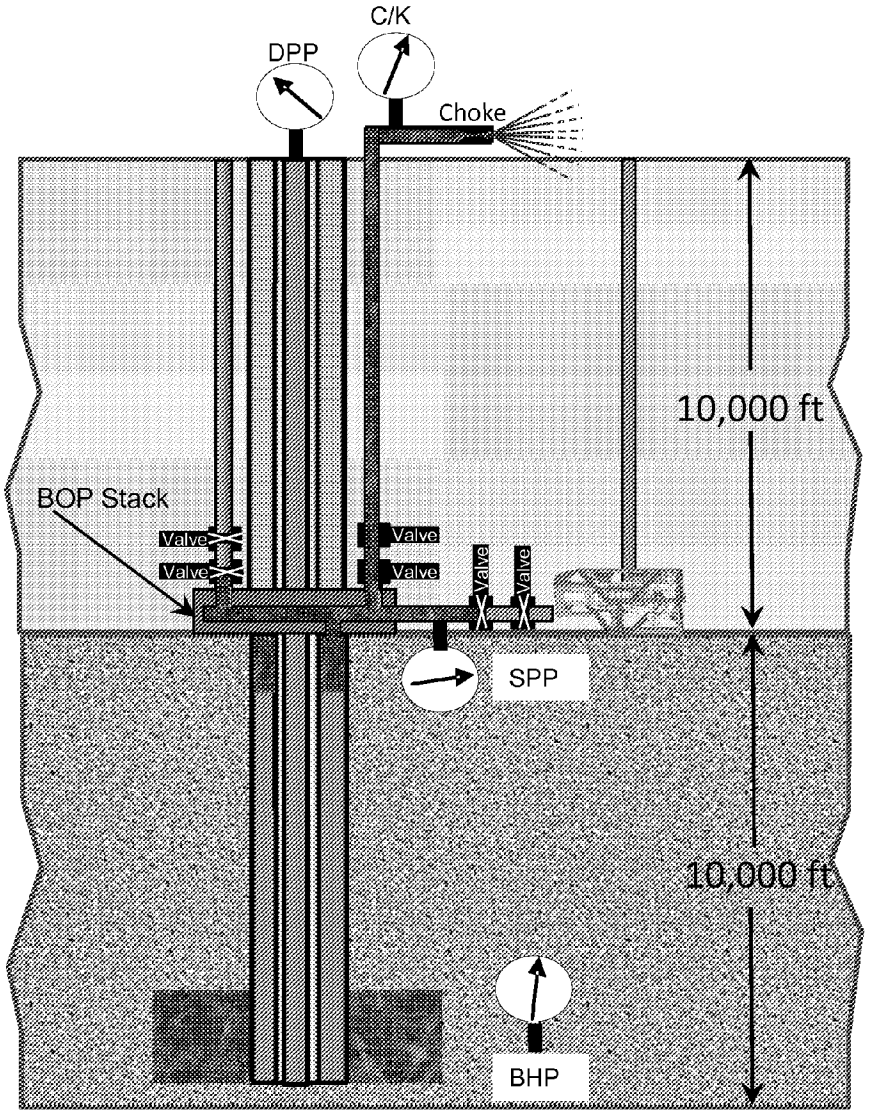

FIG. 9 shows that while the kick volume at the bottom of the wellbore was ten barrels, the kick will expand substantially as the kick moves up the choke line 24 to the surface. The choke line 24 unit volume in the present example 0.0197 bbl/ft. Thus, in a system in 10,000 feet water depth, the total choke line volume is 197 barrels.

Figure 10:
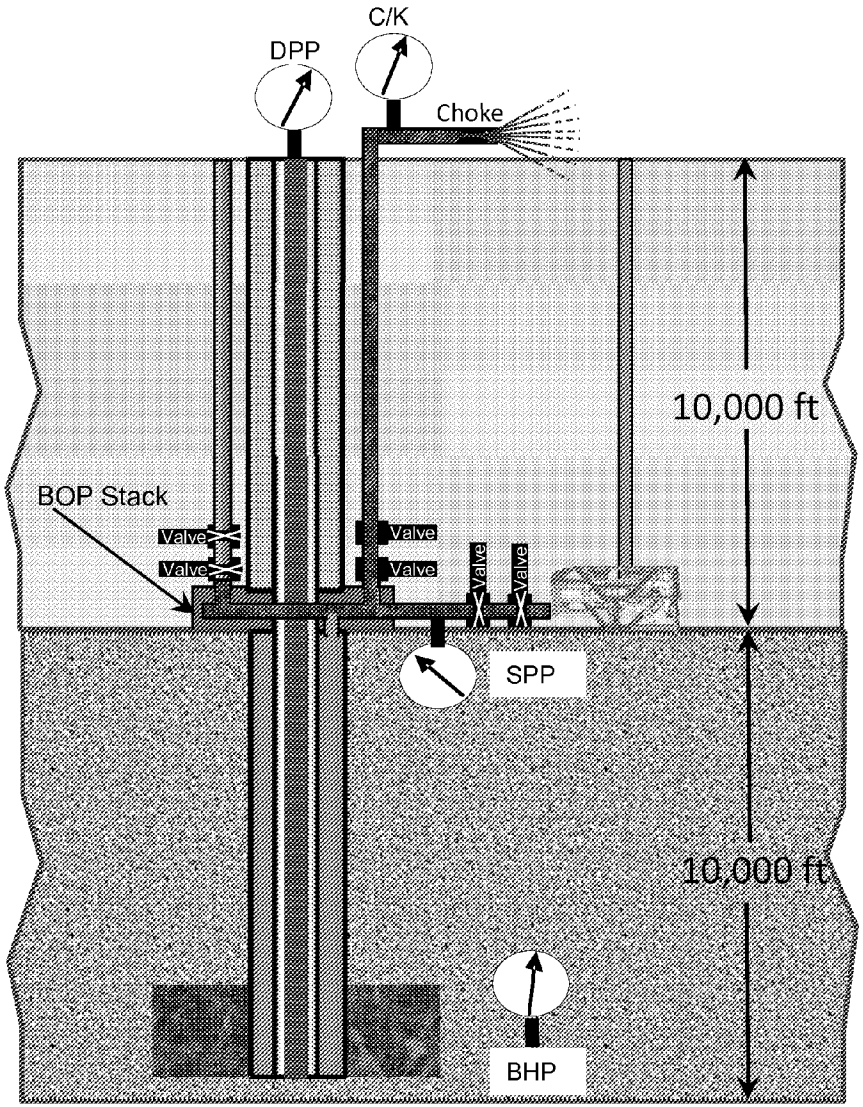

FIG. 10 shows the surface choke 44 being operated to keep bottom hole pressure constant as the kick fluid is discharged through the choke 44. A typical indication that bottom hole pressure is constant is a constant drill string pressure (as shown by sensor DPP).

Figure 11:
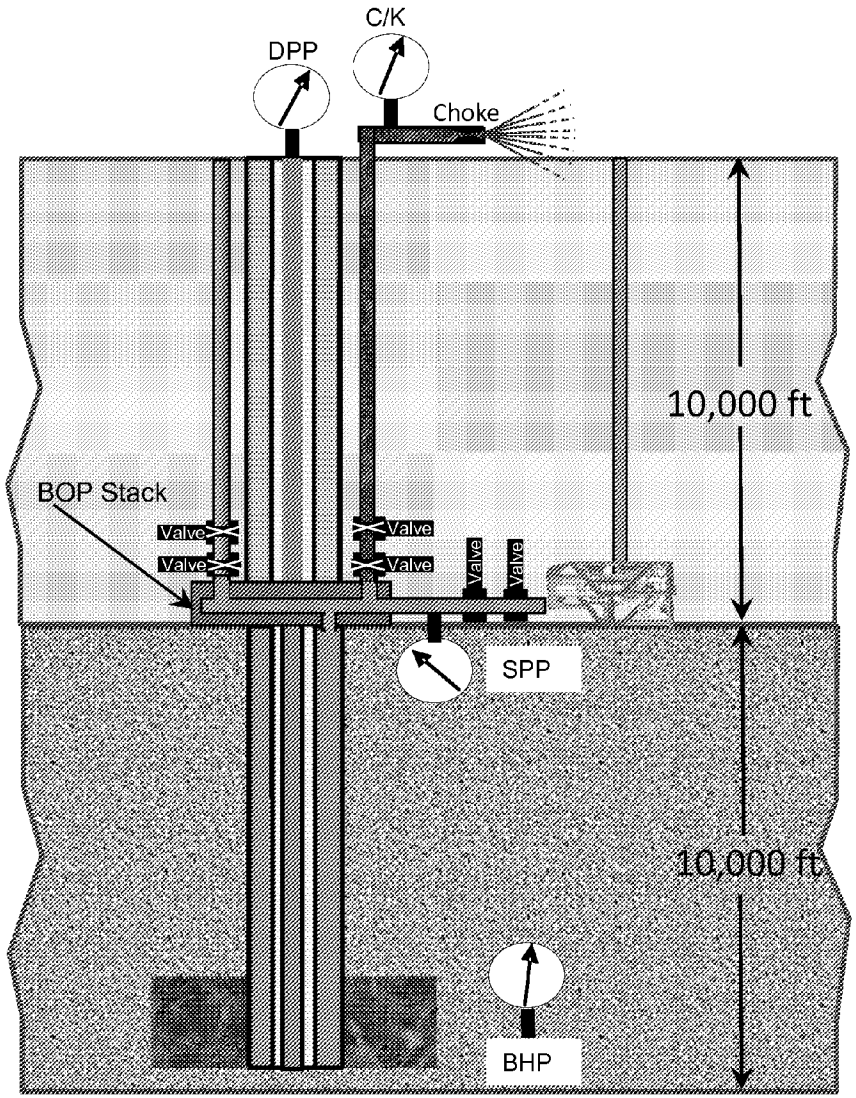

FIG. 11 shows restarting the mud return pump 38. The valves 34, 36 to the mud return pump 38 inlet are opened, and the valves 30, 32 to the choke line 24 are also open. The intake pressure set point on the mud return pump 38, measured by sensor SPP, is set to match the existing pressure at the mud return pump 38 intake The valves 30, 32 to the choke line 24 are then closed.

Figure 12:
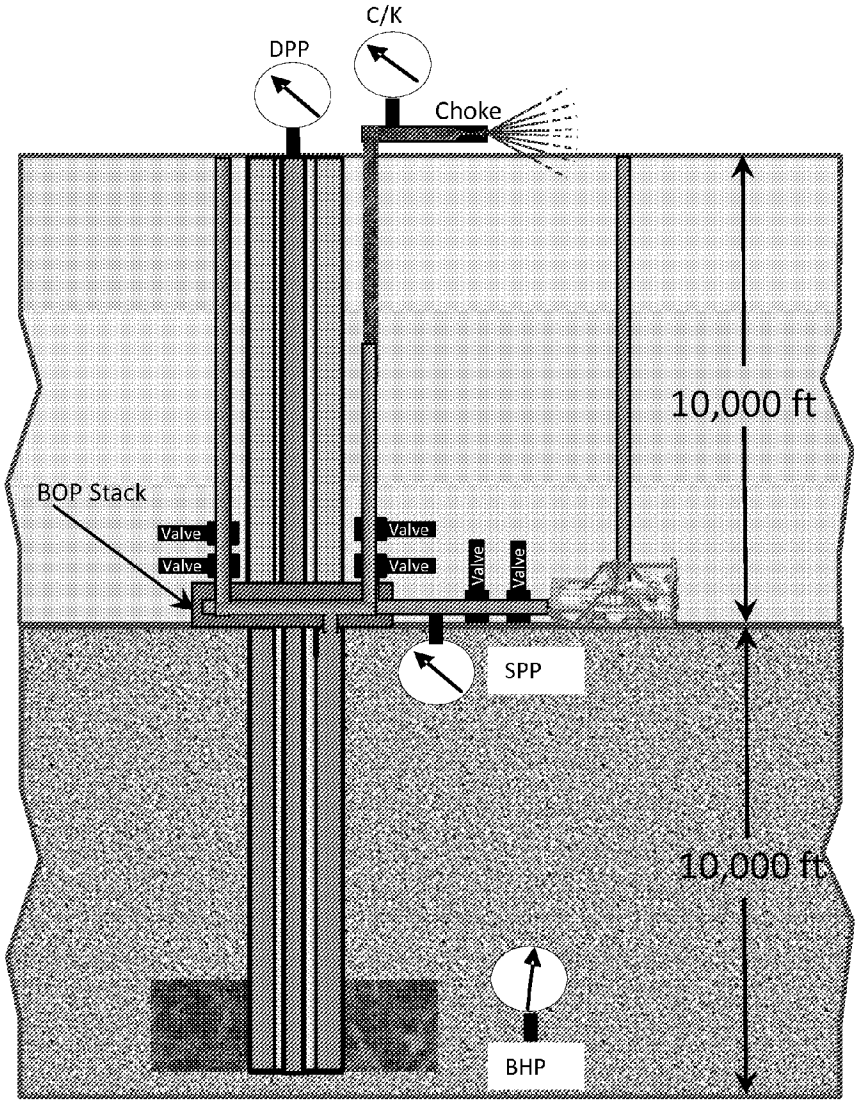

FIG. 12 shows connecting one of the other auxiliary lines, e.g., the kill line 22 to the choke line 24 using bypass lines or internal passages the BOP stack 16. The valves 30, 32 at the base of the choke line and the kill line 18, 20 are then opened. Sea water is pumped from the surface down the kill line 22, back up the choke line 24. Such pumping displaces the kick fluid 50 from the choke line 24.

Figure 13:
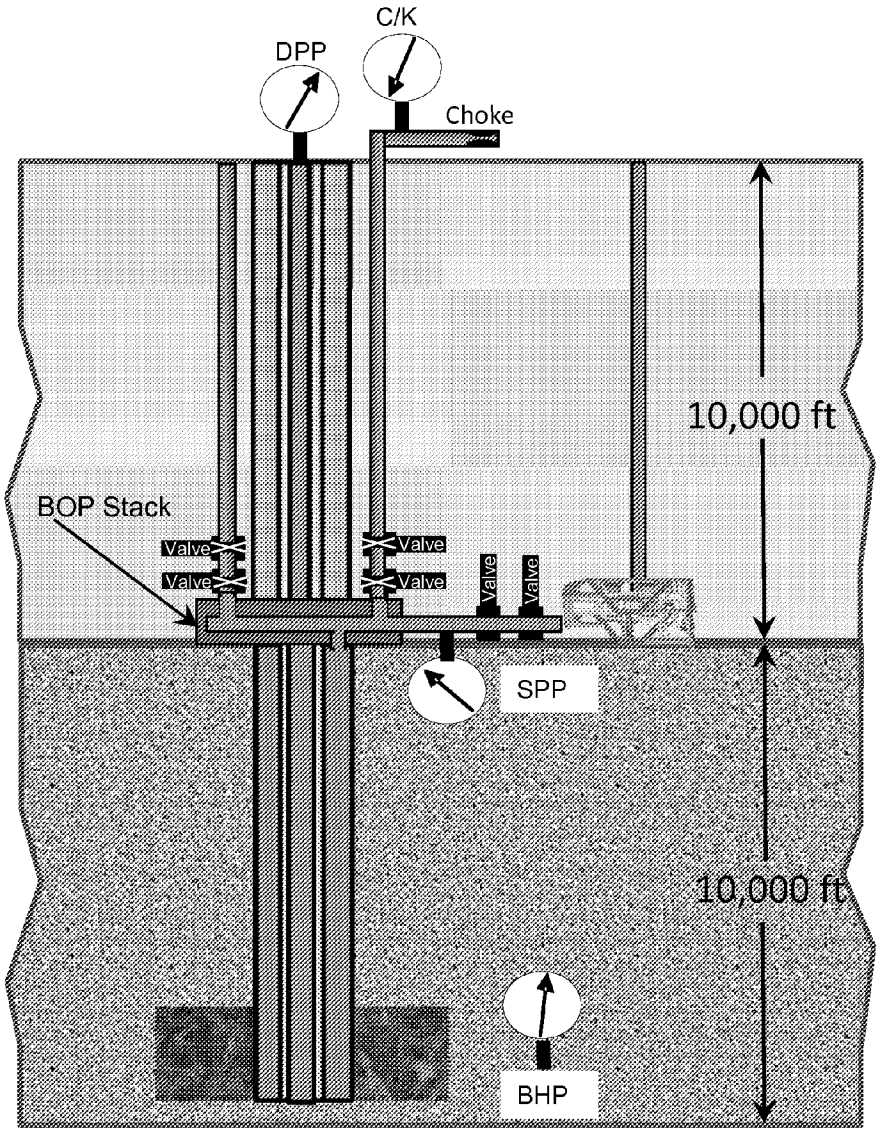

FIG. 13 shows that once kick fluid 50 is fully displaced from the choke line 24, the well choke pressure (which may be measured by sensor CK) is zero. At this point any connection between the boost line 22 and the choke line 24 may be removed or closed. The wellbore 24 is then returned to regular drilling control by the following procedure, which takes into account the higher fluid pressure in the rock formation from which the kick originated.

Figure 14:
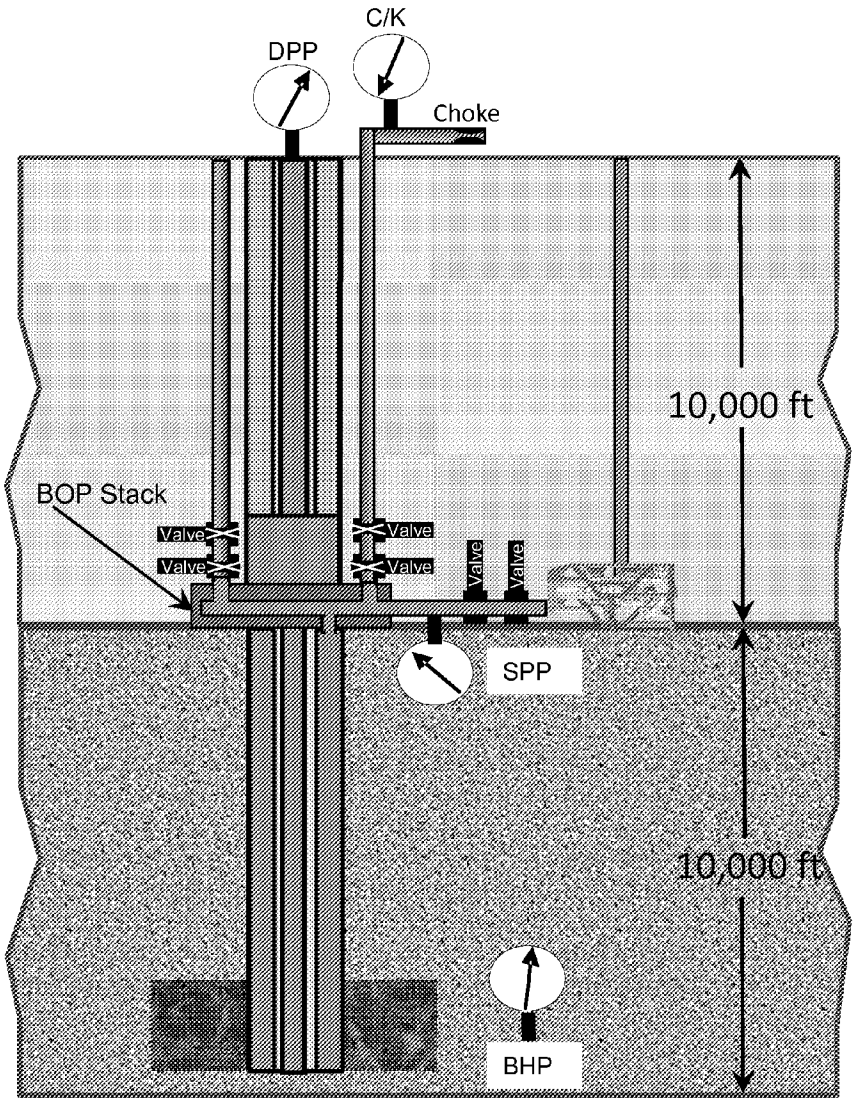

FIG. 14 shows pumping mud through the boost line (not shown). The boost line is placed in hydraulic communication with the lower end of the riser 26. Pumping continues down the boost line until the fluid pressure at the bottom of the riser 26 equals the pressure in the wellbore existing at the BOP stack 16. This pressure is the existing pressure (measured by the sensor SPP) at the mud return pump 38 intake.

Figure 15:
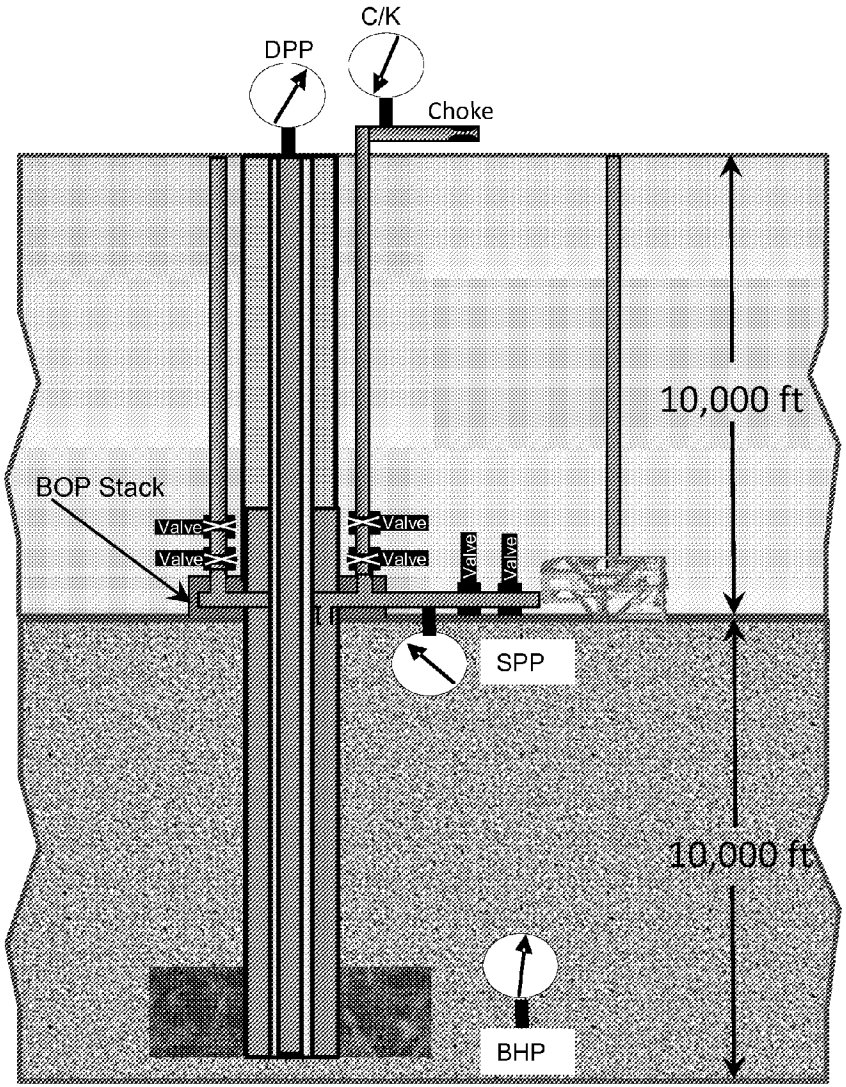

FIG. 15 shows the annular preventer being opened, the choke line 24 valves 30, 32 and the kill line 22 valves 18, 20 being closed, and normal drilling resuming with a new fluid level interface in the riser 26. The new fluid interface level in the riser 26, being higher than the interface level shown in FIG. 1, provides a greater bottom hole pressure than with the interface as shown in FIG. 1. Thus, formations having higher fluid pressure may be safely drilled without fluid entry into the wellbore 14.

It will be appreciated by those skilled in the art that the foregoing method may also be used when no riser connects the wellhead to the drilling unit. In such examples, the wellhead may have affixed to the top thereof a rotating diverter, rotating BOP or rotating control head that directs fluid from the annular space surrounding the drill string 28 to the pump 38 intake. The intake pressure of the pump SPP will be adjusted for the lack of a column of liquid applied to the wellbore annulus in "riserless" configurations. The principle of operation of the method is substantially the same for the riser version shown and explained with reference to the figures as it is in riserless configurations.

A method according to the invention may enable safe control of fluid influx into a wellbore being drilled without the need to shut in the wellbore and without the need to increase the density of drilling mud to prevent further fluid influx.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for removing a fluid influx from a wellbore, the wellbore drilled using a drill string having an internal passage therethrough, the wellbore having a wellhead disposed proximate a bottom of a body of water disposed thereabove, a fluid outlet of the wellbore coupled to an inlet of a mud return pump, an outlet of the return pump coupled to a return line to the water surface, the method comprising:

detecting the influx;

diverting flow from the wellbore from the return pump to a choke line when the influx reaches the wellhead;

operating a choke in the choke line so that a substantially constant bottom hole pressure is maintained, while continuing fluid flow into the drill string, the bottom hole pressure being less than a hydrostatic pressure that would be exerted by a column of the fluid flowing into the drill string from a surface of the water to a bottom of the wellbore; and redirecting fluid flow from the wellbore to the return pump inlet when the influx has substantially left the well.

2. The method of claim 1 further comprising changing an interface level in a riser connected between the wellhead and the surface, the interface level being between a less dense fluid and the fluid pumped through the drill string to increase fluid pressure at the bottom of the wellbore.

3. The method of claim 1 wherein the choke line is initially filled with sea water.

4. The method of claim 2 wherein the less dense fluid comprises sea water.

5. The method of claim 2 wherein the riser is in hydraulic communication with an annular space in the wellbore both before the detecting and after the changing interface level.

6. The method of claim 2 wherein the fluid interface level is changed by pumping drilling fluid into a base of the riser through a riser kill line.

7. The method of claim 1 wherein after the detecting, a rate of the fluid return pump is reduced until a rate of the fluid pumped into the wellbore is substantially the same as a rate of fluid flowing out of the wellbore.

8. The method of claim 1 further comprising removing the fluid influx from the choke line by pumping a less dense fluid down an auxiliary line in hydraulic communication at a lower end thereof with a lower end of the choke line until the less dense fluid reaches the choke, the less dense fluid being a lower density than the fluid flowing into the drill string.

9. The method of claim 1 further comprising closing an annular blowout preventer after the detecting.

10. The method of claim 9 further comprising pumping drilling fluid into a base of the riser through a riser auxiliary line to raise an interface level between the fluid pumped through the drill string and the less dense fluid.

11. The method of claim 10 further comprising opening the annular blowout preventer after the interface level is raised.

12. The method of claim 1 further comprising:

pumping a less dense fluid down an auxiliary line from the surface to proximate a bottom end thereof and thereto proximate a bottom end of the choke line, the less dense fluid being a lower density than the fluid flowing into the drill string; and displacing influx fluid from the choke line.

* * * * *